US009929507B2

(12) United States Patent
Pickel et al.

(10) Patent No.: US 9,929,507 B2
(45) Date of Patent: Mar. 27, 2018

(54) SELF-ALIGNING CONNECTOR INTERFACE

(71) Applicant: SPINNER GmbH, München (DE)

(72) Inventors: Augustin Pickel, Gars am Inn (DE); Thomas Binder, Bruckmühl (DE)

(73) Assignee: SPINNER GMBH, Munich (DE)

( * ) Notice: Subject to any disclaimer, the term of this patent is extended or adjusted under 35 U.S.C. 154(b) by 0 days.

(21) Appl. No.: 15/593,026

(22) Filed: May 11, 2017

(65) Prior Publication Data

US 2017/0271817 A1 Sep. 21, 2017

Related U.S. Application Data

(63) Continuation of application No. PCT/EP2015/076242, filed on Nov. 10, 2015.

(30) Foreign Application Priority Data

Nov. 11, 2014 (EP) ..... 14192626
Jun. 24, 2015 (EP) ..... 15173523

(51) Int. Cl.
*H01R 13/64* (2006.01)
*H01R 13/631* (2006.01)
*H01R 24/40* (2011.01)

(52) U.S. Cl.
CPC ..... *H01R 13/6315* (2013.01); *H01R 24/40* (2013.01)

(58) Field of Classification Search
CPC ..... H01R 13/6315; H01R 2103/00; H01R 9/0521
USPC ..... 439/246–248, 578, 581–585
See application file for complete search history.

(56) References Cited

U.S. PATENT DOCUMENTS 1,101,939 A * 6/1914 Knauff ..... H01R 13/6315 439/248
1,966,234 A * 7/1934 Cox ..... H01R 13/6315 200/258
3,133,776 A * 5/1964 Magers ..... H01R 13/502 439/248

(Continued)

FOREIGN PATENT DOCUMENTS

CN 101286607 A 10/2008
CN 102136658 A 7/2011

(Continued)

OTHER PUBLICATIONS

Search Report and Written Opinion in International Application No. PCT/EP2015/076242 dated Jan. 27, 2016.

(Continued)

*Primary Examiner* — Thanh Tam Le
(74) *Attorney, Agent, or Firm* — Norton Rose Fulbright US LLP

(57) ABSTRACT

A self-aligning RF connector interface comprises an electrical feed-trough with a connector body and an internal connector. The connector body defines a longitudinal axis. The connector interface further comprises a centering collar, a connector guide and an outer housing. The centering collar is spring loaded by a second axial spring and retractable with respect to the connector body. The connector body is spring loaded by a first axial spring and retractable and tiltable with respect to the connector guide. The connector guide is movable in a plane transverse to the longitudinal axis.

8 Claims, 2 Drawing Sheets

(56) References Cited

U.S. PATENT DOCUMENTS

| | | | | | |
|---|---|---|---|---|---|
| 4,697,859 | A * | 10/1987 | Fisher, Jr. | H01R 13/6315 | 439/246 |
| 4,824,400 | A * | 4/1989 | Spinner | H01P 1/045 | 333/254 |
| 4,941,846 | A * | 7/1990 | Guimond | H01R 24/542 | 439/180 |
| 5,071,364 | A * | 12/1991 | Bourgie | H01R 13/641 | 439/248 |
| 5,397,244 | A * | 3/1995 | Generoli | B64G 1/641 | 439/248 |
| 5,938,474 | A * | 8/1999 | Nelson | H01R 9/0521 | 439/578 |
| 6,344,736 | B1 | 2/2002 | Kerrigan | 324/750.16 | |
| 7,351,098 | B2 * | 4/2008 | Gladd | H01R 9/037 | 439/271 |
| 7,422,456 | B1 | 9/2008 | Mitani | 439/248 | |
| 8,641,446 | B1 * | 2/2014 | Chen | H01R 13/4538 | 439/141 |
| 2007/0243730 | A1 | 10/2007 | Gladd | 439/98 | |

FOREIGN PATENT DOCUMENTS

| | | | |
|---|---|---|---|
| CN | 104184003 | A | 12/2014 |
| GB | 918 009 | A | 2/1963 |
| JP | S62-107478 | | 7/1987 |
| JP | H10-294157 | | 11/1998 |
| JP | 2007 087682 | A | 4/2007 |
| JP | 2007-87682 | A | 4/2007 |
| WO | WO/13/061486 | | 5/2013 |

OTHER PUBLICATIONS

Extended European Search Report in European Application No. 15173523.0 dated Jan. 27, 2016.

Notice of Intent to Grant in European Application No. 15173523.0 dated Sep. 8, 2016.

Response to Notice of Intent to Grant in European Application No. 15173523.0 filed Dec. 13, 2016.

Notice of Intent to Grant in European Application No. 15173523.0 dated Jan. 13, 2017.

Decision to Grant in European Application No. 15173523.0 dated Jan. 26, 2017.

Office action in Japanese Application No. 2017-525597 dated Sep. 25, 2017.

Office action in Chinese Application No. CN 201580061200.0 dated Dec. 13, 2017.

* cited by examiner

SELF-ALIGNING CONNECTOR INTERFACE

PRIORITY CLAIM

This application is a continuation of pending International Application No. PCT/EP2015/076242 filed on Nov. 10, 2015, which designates the United States and claims priority from European Application No. 14192626.1 filed on Nov. 11, 2014 and European Application No. 15173523.0 filed on Jun. 24, 2015, each of which is incorporated herein by reference in its entirety.

BACKGROUND OF THE INVENTION

1. Field of the Invention

The invention relates to a self-aligning connector, preferably to a self-aligning RF connector, i.e. a connector, which automatically aligns to a mating connector during the coupling operation.

2. Description of Relevant Art

For testing electronic devices test adapters are often used. These test adapters connect with devices to be tested to external test equipment. When testing RF devices like amplifiers, filters or others, these often have to be connected by RF connectors, which in most cases are coaxial connectors. These have comparatively tight mechanical tolerances and require a precise connection. The same problem applies to connections by waveguides and/or by optical connectors. When the connectors are attached manually to the device to be tested, the test adapter's connectors have flexible cables and are manually attached to the device to be tested. If an automatic connection between a device to be tested and a test adapter is desired, mechanical tolerances may cause severe problems. Basically, a test adapter may be built with close mechanical tolerances, but the devices to be tested are often manufactured in larger quantities and often have wider mechanical tolerances. This may lead to a misalignment of the connectors which may further lead to a damage of the connectors or to incorrect test results. Generally it would be preferred, if the connectors of the measuring adaptor and the mating connectors of the device to be tested are exactly aligned in all planes and directions.

U.S. Pat. No. 6,344,736 B1 discloses a self-aligning connector. The connector body is held over an outer radial flange, provided at its outer surface, between an inner radial flange provided at the inner surface of the connector housing and a washer pressed by an axial spring, so that it can align to a mating connector being inserted into the centering collar fixed to the connector body at least axially and in the transverse plane. Movement in the transverse plane is effected against a relatively high but not exactly defined force brought up by the axial spring over the washer to the outer flange of the connector body. Further, a radial intermediate position of the connector body in the connector housing is not defined, so that during the coupling procedure eventually not only a radial misalignment of the mating connector but also a misalignment of the connector body has to be adjusted. An automatic restoring of the connector body into its radial intermediate position after disconnecting is not provided.

A further disadvantage of the known connector device will be seen in that a tilt of the connector body is only possible against the relatively high force of the axial spring, when the tilting movement by means of the outer flange of the connector body and the washer is transferred to the axial spring.

SUMMARY OF THE INVENTION

The embodiments are based on the object of providing a self-aligning connector, wherein a movement of the connector body in the transverse plane is effected against a defined force which restores the device after disconnecting back to a centered initial position, wherein further tilting of the connector body is performed largely without having to overcome significant forces, and wherein the connector body after disconnecting is restored and fixed into a precisely coaxial position.

In an embodiment, a self-aligning connector interface has at least an electrical feed-trough with a connector body and an internal connector, a centering collar, a connector guide and an outer housing. The connector interface may be held within a test adapter by the outer housing. The connector body comprises all the components for a required electrical connection. In the case of a coaxial RF connector, it may have an inner conductor and an outer conductor. It not necessarily needs to have locking components like a locking nut. The connector body may be connected to an electrical or coaxial line forming the feed through or may be part thereof. The connector body defines a longitudinal axis, which preferably is a center axis by its geometrical center, the longitudinal axis is along a plug-in direction in which the connector body is connected. The connector body is preferably held within a centering collar for centering the connector to a mating connector of the device to be tested. Most preferably, the connector body is arranged coaxially within the centering collar. The connector body is further supported tiltably against its longitudinal axis and slidably along its longitudinal axis within the connector guide. The connector guide is held within the outer housing movable within a plane transverse to the longitudinal axis. This assembly allows for longitudinal (along the longitudinal axis), lateral (transverse to the longitudinal axis) and tilt (angled to the longitudinal axis) adjustment of the connector body to precisely fit into the mating connector. Movements in these three degrees of freedom are preferably preloaded by elastic elements and/or springs, further generally referred to as springs. When the connector interface is not connected to a mating connector, it is preferably forced into an initial position by the elastic springs.

Furthermore, it is preferred, if the connector guide is arranged in the outer housing, being movable in the transverse plane against the force of a centering spring. The connector body therefore is preferably arranged in the outer housing so that no forces act against any tilting movement, and may be tilted as soon as it is axially shifted from the initial position into an operating position.

Preferably, the feed-through has a rigid body, mechanically connecting the connector body and the internal connector. In an alternate embodiment, the feed through may have a cable or a waveguide to connect the connectors.

It is further preferred, if in this initial position, without contact to a mating connector, the connector body is mechanically centered in the connector guide by centering means. When the connector interface is displaced into its operating positions in a plug-in-direction, the connector body is released to tilt in the connector guide. By this way, the connector interface in its initial state is in a completely neutral position, so that when a mating connector is coupled, no misalignment of said self-aligning connector but only eventual misalignments of the mating connectors of the device to be tested have to be adjusted.

Preferably, the centering means comprise cooperating annular projections formed at the outer periphery of the connector body, the tube sleeve or the feed-through and at the inner periphery of the connector guide, respectively, the edges of said projections facing to each other in the displaced position of the connector body being chamfered to facilitate engagement of the centering means.

It is further preferred, if the centering collar is arranged on the connector body displaceable from an initial position in the plug-in direction, along the longitudinal axis and against the force of a second axial spring. Preferably, the second axial spring is configured to be compressed before the first axial spring, such that the mating connectors are coupled before the first axial spring is compressed. Accordingly, after the mating connector has been centered, the centering collar is pushed back to allow for coupling of the connectors.

According to a further embodiment, there may be no second axial spring. In this case, the centering collar must be short enough to enable mating of the connectors.

In an alternate embodiment, the second axial spring may be configured so that the force transferred from a mating connector to the centering collar in the coupling procedure is at first transferred to the connector body, so that it is axially displaced and released for tilting before the second axial spring is compressed with increasing counteracting force of a first axial spring, allowing coupling of the mating connector with the connector body.

In a preferred embodiment, the centering collar is retractable. Therefore, it may center the connector to the mating connector when approaching. Most preferably, the centering collar may be completely retracted, so that it asserts no centering force to the connectors, when the connectors are mated. Preferably, the centering collar is spring loaded to extend the collar to its full length, when the connector interface is in its initial position.

In order to minimize the force required to move the connector body with the connector guide in a transverse plane, the connector guide preferably is movably arranged in the outer housing by means of low friction glide bearings.

The first axial spring and the second axial spring preferably are formed as helical compressions springs which are available in a plurality of sizes and characteristics.

Preferably, the first axial spring has a higher initial spring force than the second axial spring. Preferably, the first axial spring has a higher stiffness than the second axial spring. In this way, at the coupling procedure, the second axial spring will contract first and allow the mating connector to mate with the contacts of the connector body before the connector body is released for tilting movement.

BRIEF DESCRIPTION OF THE DRAWINGS

In the following, the idea and implementation of the invention will be described by way of example, without limitation of the general inventive concept, and with reference to the drawings.

Figure 1:
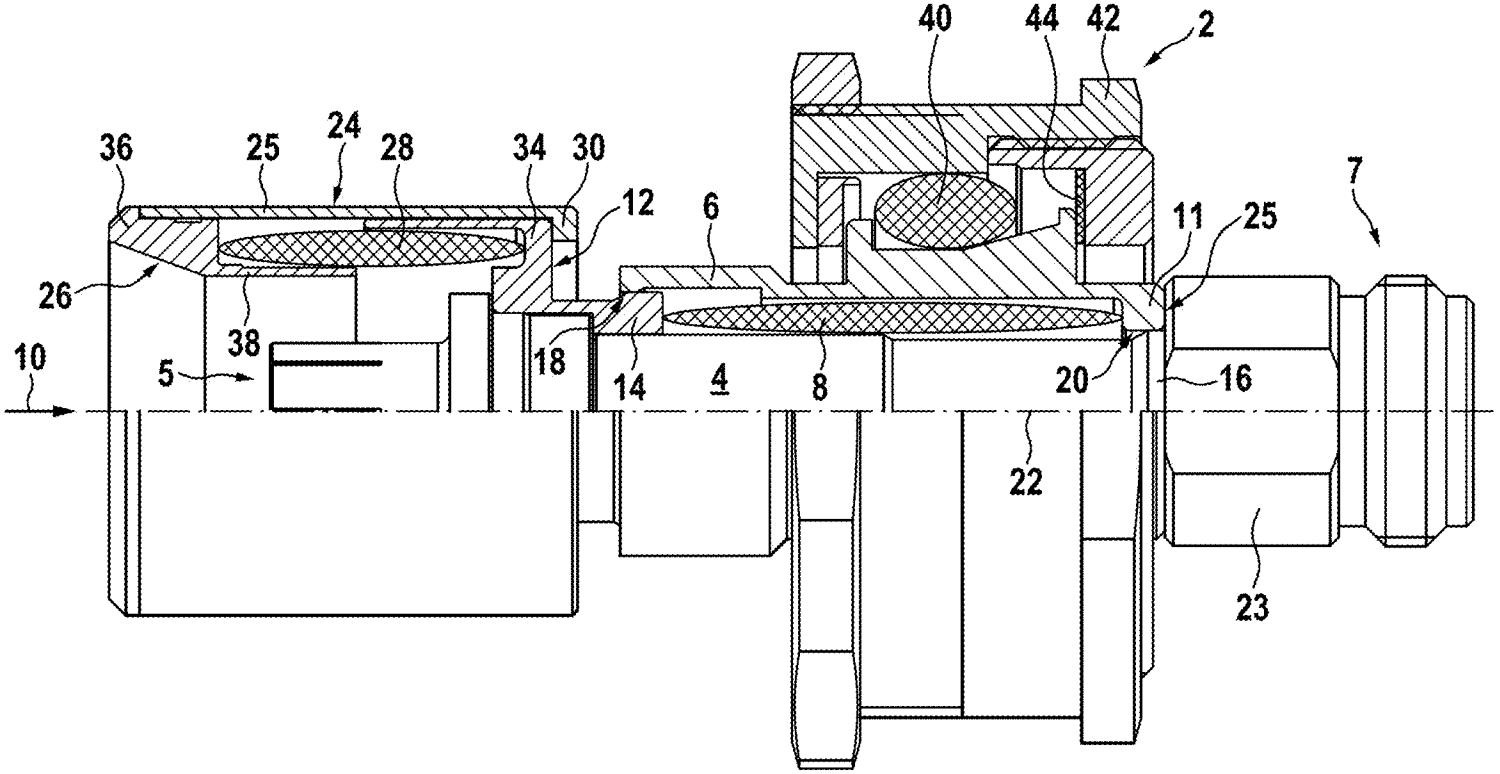
FIG. 1 shows a half-sectional side view of a self-aligning connector in an initial state.

While the implementations of the invention are susceptible to various modifications and alternative forms, specific embodiments are illustrated in the drawings and are described in detail. It should be understood, however, that the drawings and detailed description thereto are not intended to limit the invention to the particular disclosed form, but to the contrary, the intention is to cover all modifications, equivalents and alternatives falling within the spirit and scope of the present invention as defined by the appended claims.

DETAILED DESCRIPTION

In FIG. 1 a preferred embodiment is shown. The self-aligning connector 2 comprises a feed-through 4, which at a first end, at the left side in the figures, carries a connector body 5, which may be coupled with a mating connector (not shown) for instance of a device to be tested. The feed-through may be connected with a test and measuring device by means of a further cable, not shown, to internal connector 7. The connector body 5 defines a longitudinal axis 22, which preferably is the longitudinal axis of the feed-through 4. For establishing a connection to a device to be tested, a mating connector of a device to be tested is moved in a plug-in direction 10 towards the connector body 5 until the connector body and the mating connector mate.

The feed-through 4 is arranged in a connector guide 6, axially displaceable against the force of a first axial spring 8 from the initial position shown in FIG. 1 in the plug-in direction 10. The first axial spring 8 is configured as a compression spring between an end wall 11 of the connector guide 6 and a tube sleeve 12 fixed to the connector body 5 and extending against the plug-in direction 10. Structure and function of said tube sleeve 12 will be explained further below.

As is shown in FIG. 1, the connector body 5 within the tube sleeve 12 in its initial position is centered by means of a first annular projection 14 formed on the outer periphery of the connector body 5 or tube sleeve 12 abutting inner peripheral surfaces 18 of the connector guide 6. Further centering may be supported by a second annular projection 16 at the feed-through 4, abutting respective inner peripheral surfaces 20 of the connector guide 6. It is preferred, if the feed-trough is of a stiff material, like a metal tube, or is at least supported by such a stiff material.

Figure 2:
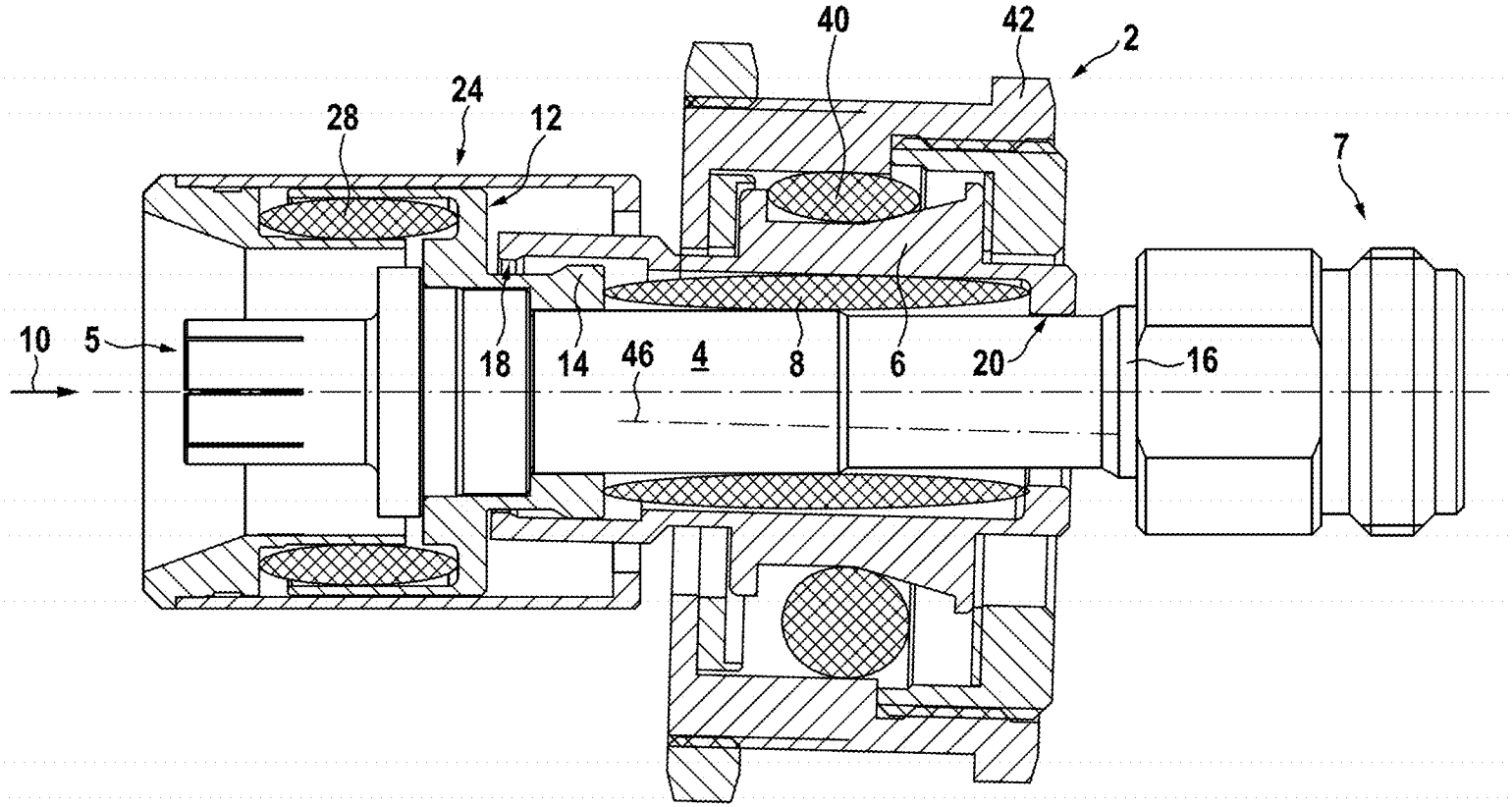
FIG. 2 is a full-sectional side view of the connector of FIG. 1 in a state with springs deflected and the connector body slightly tilted.

When the connector body 5 in the coupling procedure is displaced in the plug-in direction by the mating connector, first annular projection 14 and second annular projection 16 come out of engagement with the respective inner peripheral surfaces 18 and 20, as shown in FIG. 2, so that the connector body 4 may be tilted with respect to the longitudinal axis 22, in order to adjust any angular misalignment of a mating connector of a device to be tested. It will be pointed out that the first axial spring 8 is spaced apart to the feed-through 4 so that a tilting movement of the connector body will not be affected.

On the tube sleeve 12 fixed to the connector guide, a centering collar 24 with an outer tube sleeve 25 and with a conical inner surface 26 tapering in the plug-in direction is arranged and displaceable against the force of a second axial spring 28, designed as a compression spring, from the initial position shown in FIG. 1 axially in the plug-in direction 10. The initial position shown in FIG. 1 is defined by an inner rim 30 formed at the centering collar and abutting against a radial end wall 34 of the tube sleeve 12. The second axial spring 28 preferably is between the end wall 34 of the tube sleeve 12 and an insert piece 36 located at the open end of the centering collar 24, the insert piece 36 preferably forming the conical inlet of the centering collar 24 as well as an inner tube sleeve 38 extending in the plug-in direction, on which the second axial spring 28 is centered.

The connector guide 6 is arranged in an outer housing 42, movable against the force of a centering spring 40 in a plane transverse to the longitudinal axis 22, in order to compensate radial misalignments of a mating connector. In order to minimize the force necessary for the transverse movement of the connector guide, the connector guide 6 is mounted in the outer housing 42 by means of low friction slide bearings 44.

The function of the self-aligning connector is as follows: If a mating connector being misaligned to the connector body of the self-aligning connector is to be coupled, the mating connector at first meets the centering collar 24 which helps in aligning the connectors. As the initial spring force of the second axial spring 28 is less than the initial spring force of the first axial spring 8, the centering collar is displaced in the plug-in direction. When the mating connector is further approached to the connector body of the self-aligning connector, the tube sleeve 12 and the connector body 4 will be displaced against the force of the first axial spring 8, whereby first and second projections 14, 16 get out of engagement with the respective inner surfaces 18, 20, allowing the connector body 4 to tilt and align to an eventual orientation misalignment of the mating connector. At the same time, the connector guide 6 is free for a movement in the transverse plane allowing to compensate any radial misalignment.

With a further movement of the mating connector in the plug-in direction, the first axial spring 8 reaches a spring force equal or higher than the initial spring force of the second axial spring 28, or further movement of the connector body 5 is blocked, so that the centering collar 24 will displace in the plug-in direction, allowing coupling or mating of the mating connector with the connector body.

FIG. 2 shows the longitudinal axis 22 of the connector body 5 being radially displaced and tilted with respect to the axis 46 of the outer housing 42.

It will be appreciated to those skilled in the art having the benefit of this disclosure that this invention is believed to provide a self-aligning RF connector. Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

LIST OF REFERENCE NUMERALS

2 self-aligning connector
4 feed-through
5 connector body
6 connector guide
7 internal connector
8 first axial spring
10 plug-in direction
11 end wall
12 tube sleeve
14 first annular projection
16 second annular projection
18 peripheral surface
20 peripheral surface
22 longitudinal axis
24 centering collar
25 outer tube sleeve
26 conical inner surface
28 second axial spring
30 inner rim
34 end wall
36 insert piece
38 inner tube sleeve
40 centering spring
42 outer housing
44 low friction bearing
46 axis of the outer housing

The invention claimed is:

1. A self-aligning connector interface, comprising:
an electrical feed-through with a connector body and an internal connector, the connector body defining a longitudinal axis,
a centering collar,
a connector guide, and
an outer housing,
wherein:
the connector body is spring loaded by a first axial spring and retractable and tiltable with respect to the connector guide,
the centering collar is spring loaded by a second axial spring and retractable with respect to the connector body, and
the connector guide is arranged in the outer housing and movable against a force of a centering spring in a plane transverse to the longitudinal axis.

2. A self-aligning connector interface according to claim 1, wherein the first axial spring has a higher stiffness than the second axial spring.

3. A self-aligning connector interface according to claim 1, wherein in an initial position without contact to a mating connector, the connector body is mechanically centered in the connector guide and tilt of the connector body with respect to the connector guide is blocked.

4. A self-aligning connector interface according to claim 1, wherein a means for centering of the connector body in the connector guide comprises cooperating annular projections formed at an inner periphery of the connector guide and at an outer periphery of the connector body, a tube sleeve, or the electrical feed-through, and
edges of said annular projections are face each other in a displaced position of the connector body and are chamfered to facilitate engagement of the means for centering.

5. A self-aligning connector interface according to claim 1, wherein the centering collar comprises:
a tube sleeve disposed at connector body, the tube sleeve extending in a direction against a plug-in direction in which a mating connector is connected to the connector body,
an outer tube sleeve disposed around the tube sleeve, the outer tube sleeve configured to slide on the tube sleeve in the plug-in direction,
an inner tube sleeve coupled to the outer tube sleeve, arranged radially inward of the tube sleeve, and extending in the plug-in direction, and
the second axial spring being arranged between said tube sleeve and said inner tube sleeve to bias the outer tube sleeve and inner tube sleeve against the plug-in direction.

6. A self-aligning connector interface according to claim 5, wherein a leading end of the outer tube sleeve includes a stop means configured to contact an end wall of the tube sleeve to limit sliding of the outer tube sleeve against the plug-in direction and thereby define an initial position of the centering collar.

7. A self-aligning connector interface according to claim 1, wherein the connector guide is movably arranged in the outer housing by glide bearings.

8. A self-aligning connector interface according to claim 1, wherein the first axial spring and the second axial spring both comprise helical compression springs.

* * * * *